US005937943A

United States Patent [19]

Butler

[11] Patent Number: 5,937,943

[45] Date of Patent: Aug. 17, 1999

[54] TUBING INSERTION AND WITHDRAWAL APPARATUS FOR USE WITH A LIVE WELL

[75] Inventor: Wilbur T. Butler, Oklahoma City, Okla.

[73] Assignee: Westbury Service Company, L.L.C., Oklahoma City, Okla.

[21] Appl. No.: 09/022,424

[22] Filed: Feb. 12, 1998

Related U.S. Application Data

[60] Provisional application No. 60/037,140, Feb. 14, 1997.

[51] Int. Cl.[6] ..... E21B 33/68; E21B 19/22

[52] U.S. Cl. ..... 166/77.2; 166/85.4; 166/85.5

[58] Field of Search ..... 166/77.1–77.3, 166/75.11, 85.4, 85.5, 381

[56] References Cited

U.S. PATENT DOCUMENTS

| | | | |
|---|---|---|---|
| 4,585,061 | 4/1986 | Lyons, Jr. et al. . | |
| 5,029,642 | 7/1991 | Crawford | 166/77.2 X |
| 5,188,174 | 2/1993 | Anderson, Jr. et al. . | |
| 5,291,956 | 3/1994 | Mueller et al. | 175/67 |
| 5,309,990 | 5/1994 | Lance . | |
| 5,411,085 | 5/1995 | Moore et al. | 166/77.2 |
| 5,454,419 | 10/1995 | Vloedman | 66/77.2 X |

*Primary Examiner*—Roger Schoeppel
*Attorney, Agent, or Firm*—Crowe & Dunlevy

[57] ABSTRACT

A coiled tubing injector for inserting and withdrawing a continuous length of tubing from a well, the coiled tubing injector having a tubing insertion and withdrawal assembly with a tubing conveyor assembly moving the tubing upward for withdrawal from the well and downward for insertion into the well. The tubing conveyor assembly has a fixed conveyor and an opposing floating conveyor each with a plurality of gripper blocks that engage the tubing. Each gripper block has a groove having a radius of curvature substantially that of the tubing to provide a close mating relationship of the gripper blocks and the tubing. The floating conveyor is moveable away from the fixed conveyor to create a gap therebetween, and the frame is provided an opening aligned with the gap between the fixed and floating conveyors so that a medial portion of the tubing can pass through the opening into the gap. A conveyor stabilizing assembly draws the floating conveyor toward the fixed conveyor to provide stabilizing support to the floating conveyor, and a grip adjustment assembly draws the fixed and floating conveyors together to close the gap and exert a gripping force on the tubing.

32 Claims, 10 Drawing Sheets

TUBING INSERTION AND WITHDRAWAL APPARATUS FOR USE WITH A LIVE WELL

CROSS-REFERENCE TO RELATED APPLICATIONS

This application claims priority to U.S. Provisional Application Ser. No. 60/037,140 filed Feb. 14, 1997, hereby incorporated by reference.

BACKGROUND OF THE INVENTION

1. Field of the Invention

The present invention relates generally to oil well equipment and services related thereto, and more particularly but not by way of limitation, to an apparatus and method to insert continuous lengths of small diameter tubing into a live oil well or the like, and for withdrawing the tubing therefrom.

2. Background

It is often advantageous to be able to install a continuous string of tubing into an oil well during development and production, as having such a tubing string installed provides the capability to pump certain types of fluid into the well for various purposes, such as for displacing undesirable fluids within the well, for stimulating production of the well and for cleaning and preventing corrosion of expensive well components. It is preferable that the tubing be inserted while the well remains pressurized to avoid the inherent risk of well casing damage associated with shutting down the well. Furthermore, it is desirable to use injection equipment and methods that minimize disruption to routine production activity.

The benefits of using inserted tubing, however, are accompanied with potentially expensive risks, and these must be minimized. A tube failure, such as tube breakage, kinking or corkscrewing, that occurs in the well can require recovery procedures that can be expensive and time consuming.

Attempts have been made to meet the needs of injecting and removing tubing in the relatively rugged environment of a well site. A device generally known as a coiled tube injector receives continuous lengths of coiled tubing, and a gripping mechanism straightens and delivers the tubing to the well. When it is desirable to remove the tubing from the well, the coiled tube injector works in reverse to withdraw the tubing from the well and pay it back onto a reel for storage. With a coiled tubing injector the same tubing can be reused many times again.

An example of a coiled tube injector is described in U.S. Pat. No. 4,585,061, issued to Lyons, Jr. et al., which illustrates a generally known approach of gripping the tubing and conveying it by a pair of opposed conveyors. The opposed conveyors provide a tube path through which the tubing is moved toward or away from the well bore, depending on the selected rotation of the conveyors.

Although improvements in the art have been made, many shortcomings of present-day coiled tubing injectors are known. One major problem is that the coiled tubing injector cannot be positioned on or removed from a continuous length of tubing without cutting the tubing. Typically, a well servicing contractor inserts the tubing to a specified well depth, and after cutting the tubing, removes the tube injector equipment from the well site. Cutting the tubing is limiting because the injected tubing obviously cannot then be used to inject fluids at a greater depth. Although welding the tubing after cutting is possible, such welding requires specialized skills and cumbersome cleaning and purging procedures. There is a need for an injector that would un-grip the tubing and then could be removed from a medial portion of the continuous tubing, leaving a substantial length of the tubing in place for use at the well site.

Another problem is that existing coiled tubing injectors are large and cumbersome, making it difficult to reach many well sites. For example, the coiled tube injector of U.S. Pat. No. 4,585,061 mentioned hereinabove requires a tractor-trailer rig that is difficult if not impossible to maneuver to many well sites. There is a need for a light weight, self-contained unit that can be transported across difficult terrain and through narrow passageways.

Still another problem is that existing coiled tubing injectors are limited to use with a single size of tubing. There is a need for a unit that accepts multiple sizes of tubing to accommodate different injection needs, depending on the flowrate and the physical properties of the fluid being injected.

The mechanical complexity of existing coiled tubing injectors is a major problem. The need to transfer a gripping force by the rotating conveyors that is sufficient to support and withdraw extremely long lengths of tubing has been met by complicated transfer assemblies made of many complicated and unique components. This results in an expensive manufacture of the apparatus, as well as expensive maintenance and repair for the operator.

There is a need for a low-cost design that simplifies the gripping action and that provides a reliable coil tubing injector requiring low-cost maintenance. These problems are resolved and other unrealized potentials in the art are gained by the present invention.

SUMMARY OF THE INVENTION

The present invention provides a coiled tubing injector for inserting and withdrawing a continuous length of tubing into and out of a well. The coiled tubing injector has a tubing insertion and withdrawal assembly which includes a tubing conveyor assembly having a fixed conveyor and an opposing floating conveyor.

The conveyor chains of both conveyors support a plurality of gripper blocks which form a groove to engage the circumference of the tubing.

The floating conveyor can be moved away from the fixed conveyor to create a gap between the conveyors. A support frame is provided an opening which is aligned with the gap so that the tubing can be passed through the opening into the gap. This allows the tubing insertion and withdrawal assembly to be placed onto or removed from a continuous length of tubing without the need to cut the tubing.

A grip adjustment assembly draws the fixed and floating conveyors together to close the gap and exert a gripping force on the tubing.

A conveyor stabilizing assembly provides stabilizing support to the conveyors.

The coiled tubing injector has a support stand assembly which clamps to a hydraulic pack-off unit which is conventionally connected to the top portion of a well head. The support stand assembly has clevis members that connect with clevis members of the tubing insertion and withdrawal assembly and is thereby hingedly connected to the support stand assembly. In this manner, the insertion and withdrawal assembly is supported by the support stand assembly and located therewith so that the tubing is linearly aligned with the hydraulic pack-off unit.

The support stand assembly provides a platform for a conventional load cell to permit monitoring of reactive forces during insertion and withdrawal of tubing.

An object of the present invention is to provide a coiled tubing injector which can insert a continuous tubing into a well bore and be removed therefrom without severing the tubing, and furthermore, a coiled tubing injector which can be reinstalled to withdraw the tubing without severing the tubing.

Another object of the present invention, while achieving the above stated object, is to provide a coiled tubing injector which can be maneuvered onto site locations that are difficult for prior art injectors to reach.

Another object of the present invention, while achieving the above stated objects, is to provide a coiled tubing injector which is economical to manufacture, reliable in operation and requires low-cost maintenance.

Other objects, advantages and features of the present invention will be apparent from the following description when read in conjunction with the accompanying drawings.

BRIEF DESCRIPTION OF THE DRAWINGS

FIG. 6A is a rear elevational view of the skate positioned by the fixed conveyor; FIG. 6B is a side elevational view thereof; and FIG. 6C is a front elevational view thereof.

FIG. 9 is a top view of the grip adjustment assembly and the conveyor stabilizing system of FIG. 8.

DESCRIPTION

Figure 1:
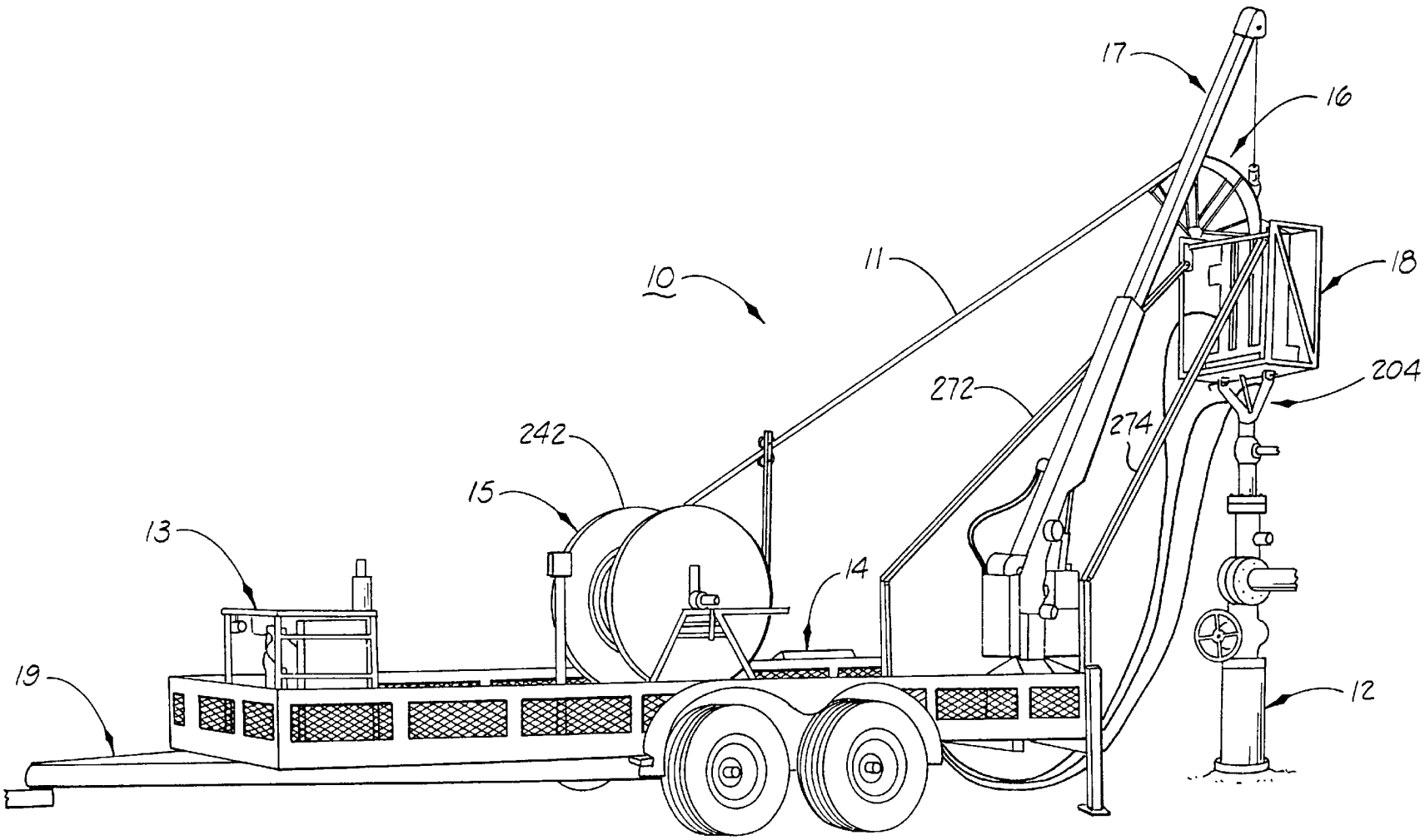
FIG. 1 shows a coiled tubing injector constructed in accordance with the present invention.

Referring to the drawings in general, and more particularly to FIG. 1, shown therein is a coiled tubing injector 10 constructed in accordance with a preferred embodiment of the present invention and injecting a tubing 11 into an oil well 12. The coiled tubing injector 10 comprises a power unit 13, a control panel 14, a tubing decoiler 15, a tubing guide 16 and an articulating boom lift 17. Also, the coiled tubing injector 10 comprises a tubing insertion and withdrawal assembly 18 which is positioned by the articulating boom lift 17 over the oil well 12. The coiled tubing injector 10 is supported and transported by a mobile platform 19. It will be noted that the mobile platform 19 of FIG. 1 is a common tandem axle trailer, and as such the size and weight of the coiled tubing injector 10 of the present invention can easily be transported by a personal vehicle such as a half-ton pickup.

Figure 2A:
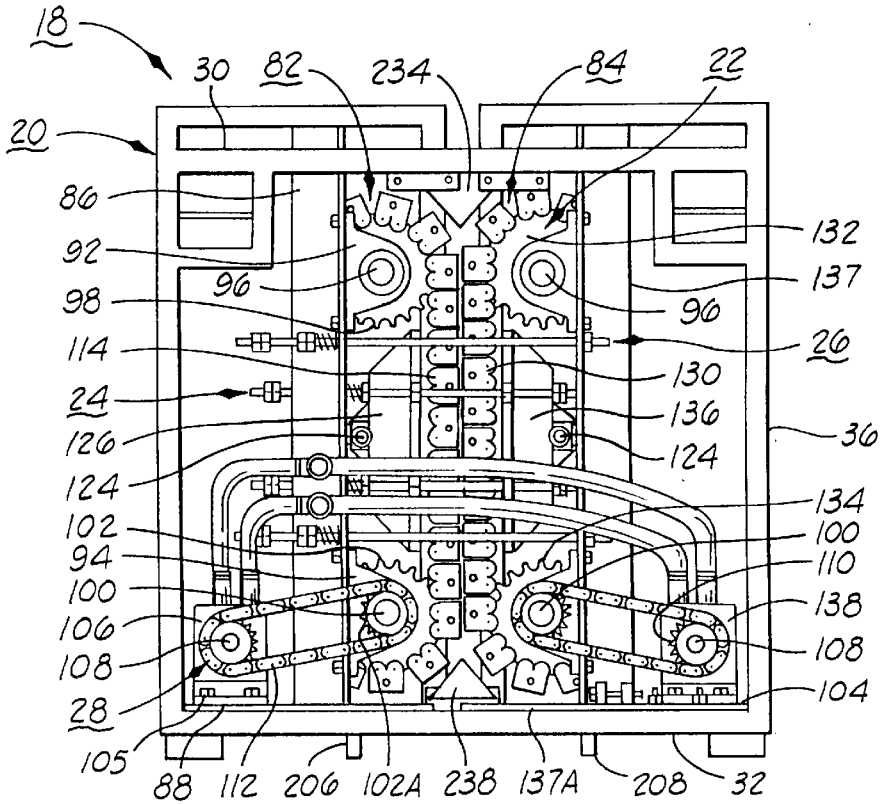
FIG. 2A is a front elevational view of the tubing insertion and withdrawal assembly of the coiled tubing injector of FIG. 1.
Figure 2B:
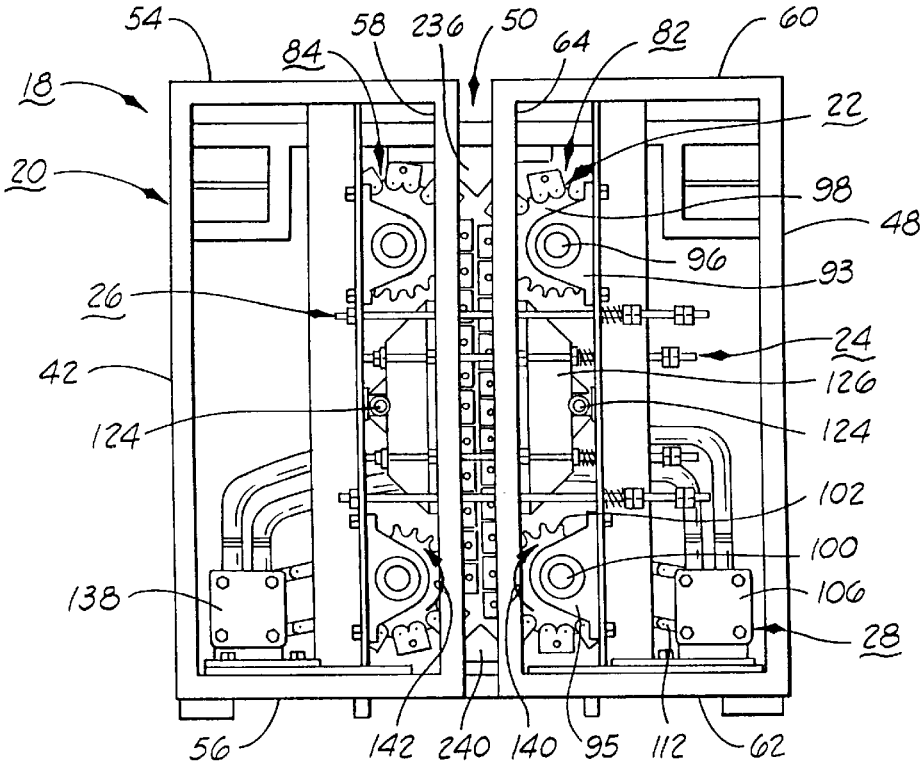
FIG. 2B is a rear elevational view of the tubing insertion and withdrawal assembly.

Referring now to FIGS. 2A and 2B, shown therein is the tubing insertion and withdrawal assembly 18 which is comprised of the following major components: a rigid support frame 20 which substantially forms a box framework; a tubing conveyor assembly 22 which is supported by the support frame 20; a grip adjustment assembly 24 which interacts with the tubing conveyor assembly 22 to position the same for gripping; a conveyor stabilizing assembly 26; and a power assembly 28 supported by the support frame 20 to drive the tubing conveyor assembly 22.

Figure 3:
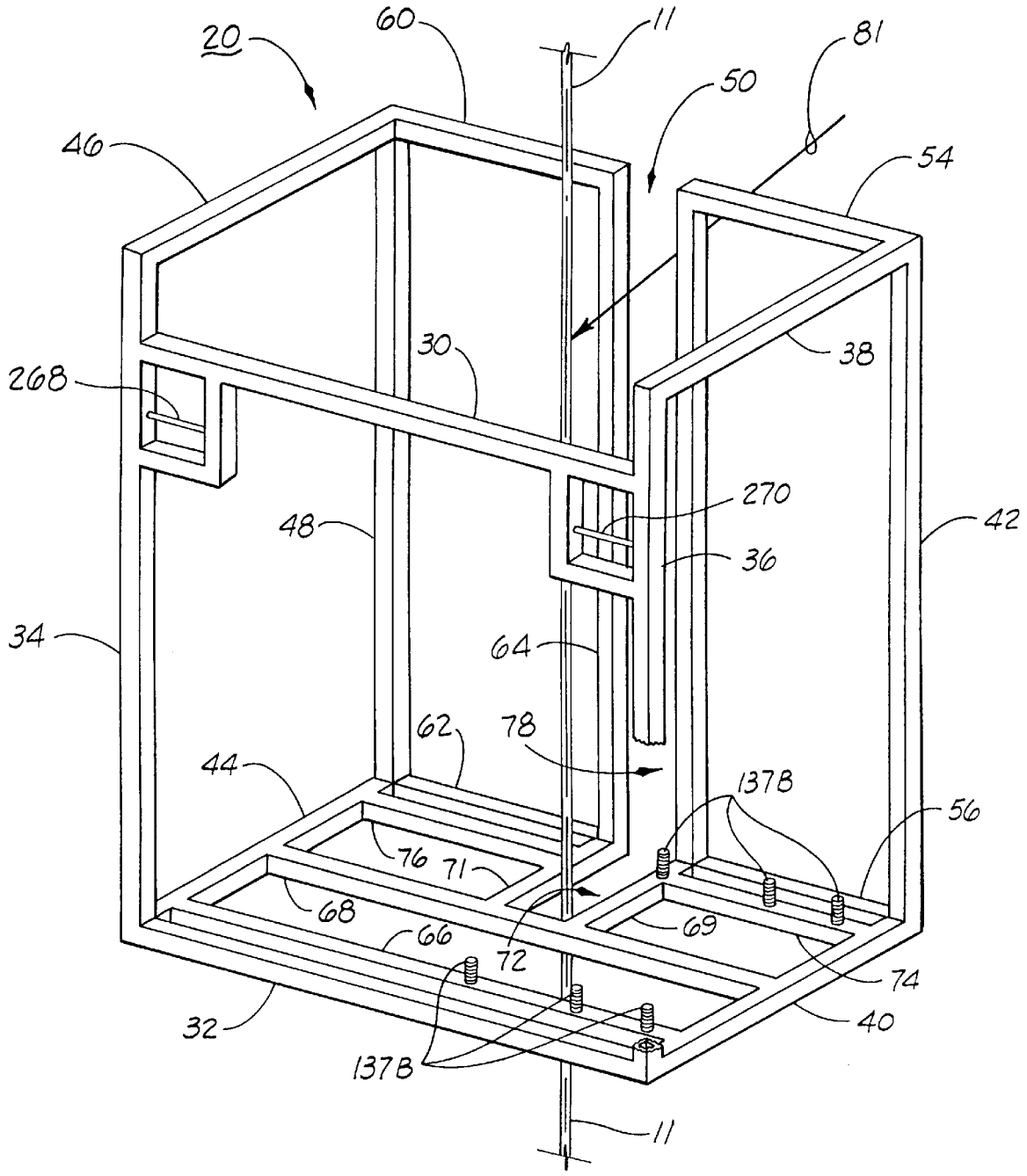
FIG. 3 is a partial, front isometric view of the framework structure of the tubing insertion and withdrawal assembly of FIG. 2A.

The support frame 20, also shown in FIG. 3, has opposing horizontal members 30, 32 joined to opposing vertical members 34, 36 which together form a closed framework on the rear face of the support frame 20. FIG. 3 shows a left-hand face of the support frame 20, having a horizontal member 38 and a horizontal member 40 extending from the vertical member 36, and a vertical member 42 attached to the distal ends of the horizontal members 38, 40. A framework is formed on the right-hand face of the support frame 20 in a similar manner, as shown seen in FIG. 3 by the joining of horizontal members 44, 46 to vertical member 34 and to a vertical member 48.

FIG. 2B is a view of the front face of the support frame 20. It will be noted that an opening 50 is formed in the front face of the support frame 20, for a purpose to be discussed hereinbelow. On one side of the opening 50, the support frame 20 has a horizontal member 54 and a horizontal member 56 extending from the vertical member 42. A vertical member 58 is attached to the horizontal members 54 and 56. In a similar manner, on the other side of the opening 50 the support frame 20 has a horizontal member 60 and a horizontal member 62, each extending from the vertical member 48 and attached to a vertical member 64.

FIG. 3 shows the bottom face of the support frame 20 has a rear support rail 66 and a middle support rail 68, both attached to the horizontal member 40 and the horizontal member 44. A horizontal member 69 is attached to the middle support rail 68 and to the horizontal member 56. A horizontal member 71 is attached to the middle support rail 68 and to the horizontal member 62. It will be noted that the horizontal member 69, the horizontal member 71, and a portion of the middle support rail 68 form an opening 72 in the bottom face of the support frame 20. Also, the opening 72 therein is contiguous to, and communicates with, the opening 50 formed in the front face of the support frame 20.

FIG. 3 shows a front support rail within the bottom face of the support frame 20 extending from both sides of the opening 72, the front support rail having a first member 74 disposed between the horizontal member 40 and the horizontal member 69, and a second member 76 disposed between the horizontal member 71 and the horizontal member 44.

The support frame 20 shown in FIG. 3 is of a conventional welded square tubing construction, as is known to one skilled in the art. Various equivalent embodiments are contemplated and may be employed with regard to tube configuration, bracing, gusseting and the like. A novel feature of the support frame 20, in conjunction with other features and elements of the present invention to be described hereinbelow, is a passageway 78, formed by the opening 50 and the opening 72, which permits moving a medial portion of a continuous length of tubing 11 in a lateral direction as is indicated by arrow 81, so as to place the medial portion of the tubing 11 inside the support frame 20.

Returning now to FIGS. 2A and 2B, the tubing conveyor assembly 22 of the tubing insertion and withdrawal assembly 18 has a laterally moveable conveyor 82, also sometimes referred to herein as the floating conveyor 82, and an opposed fixed conveyor 84. The floating conveyor 82 is slidingly supported by the support frame 20 so that the floating conveyor 82 can be separated from the fixed conveyor 84 which is rigidly supported by the support frame 20. A pair of guides (not shown) can be provided on the rear support rail 66 and the second member 76 to constrain the movement of the floating conveyor 82 in a conventional manner so as to provide lateral movement of the floating conveyor 82 relative to the fixed conveyor 84. It will be noted that a gap between the conveyors 82, 84, is formed when the floating conveyor 82 is moved away from the fixed conveyor 84. The gap is aligned with the passageway 78 so that a medial portion of tubing 11 can be moved through the passageway 78 to extend along the length of the gap.

The floating conveyor 82 has an upstanding column support 86 supported at a bottom end thereof by a base plate 88 which is slidingly supported by the rear support rail 66 and the first member 74 of the support frame 20. The column support 86 is constructed, as will become clear below, from a pair of angle-iron beams with parallel flanges that are spaced apart and joined by spreader plates.

A pair of bearings 92, 93 are attached to an upper portion of the column support 86, and a pair of bearings 94, 95 are attached to a lower portion of the column support 86. The bearings 92, 93 support a shaft 96, which in turn supports a free-wheeling sprocket 98. The bearings 94, 95 support a shaft 100 which, in turn, supports a driven sprocket 102.

The power assembly 28 has a motor baseplate 104 has a plurality of slotted apertures (not shown) through which fasteners 105 are received for locking the baseplate 104 to the base plate 88. A motor 106 is supported by the motor baseplate 104, the motor 106 having a shaft 108 depending therefrom for imparting rotational motion to a sprocket 110. The sprocket 110 is in mating alignment with a sprocket 102A which is rigidly connected to the sprocket 102, and a chain 112 is trained over the sprockets 110, 102A so as to communicate rotational motion from the motor 106 to the driven sprocket 102. Tension adjustment of the chain 112 is accomplished by loosening the fasteners 105 and moving the motor 106 relative to the sprocket 102.

Figure 4:
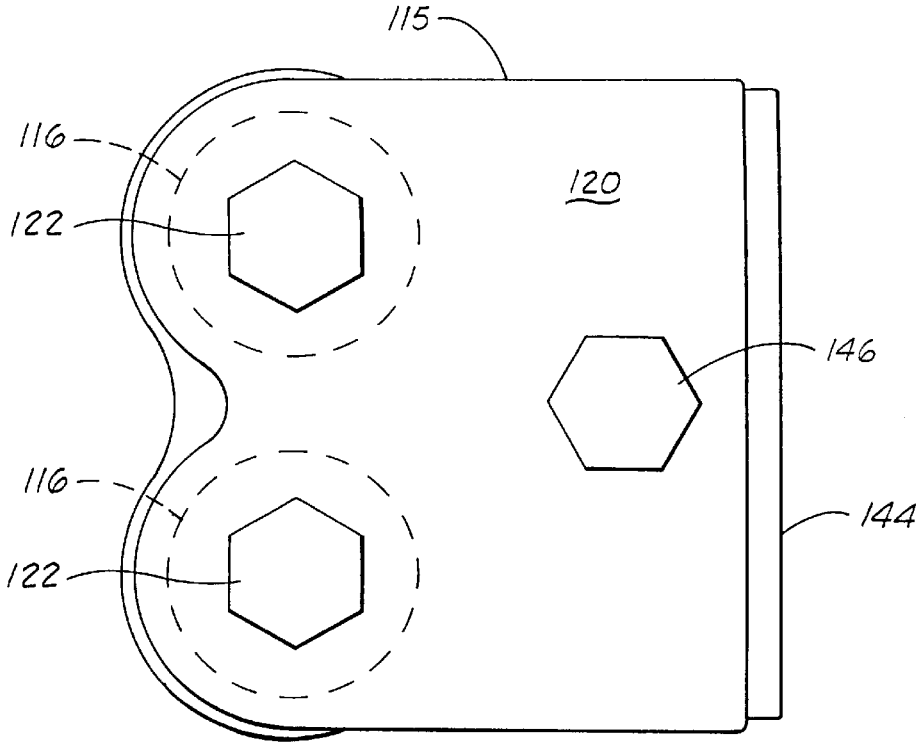
FIG. 4 is an elevational view of one link of the conveyor chain and gripper block which are part of the conveyors in the tubing insertion and withdrawal assembly of FIG. 2A.
Figure 5:
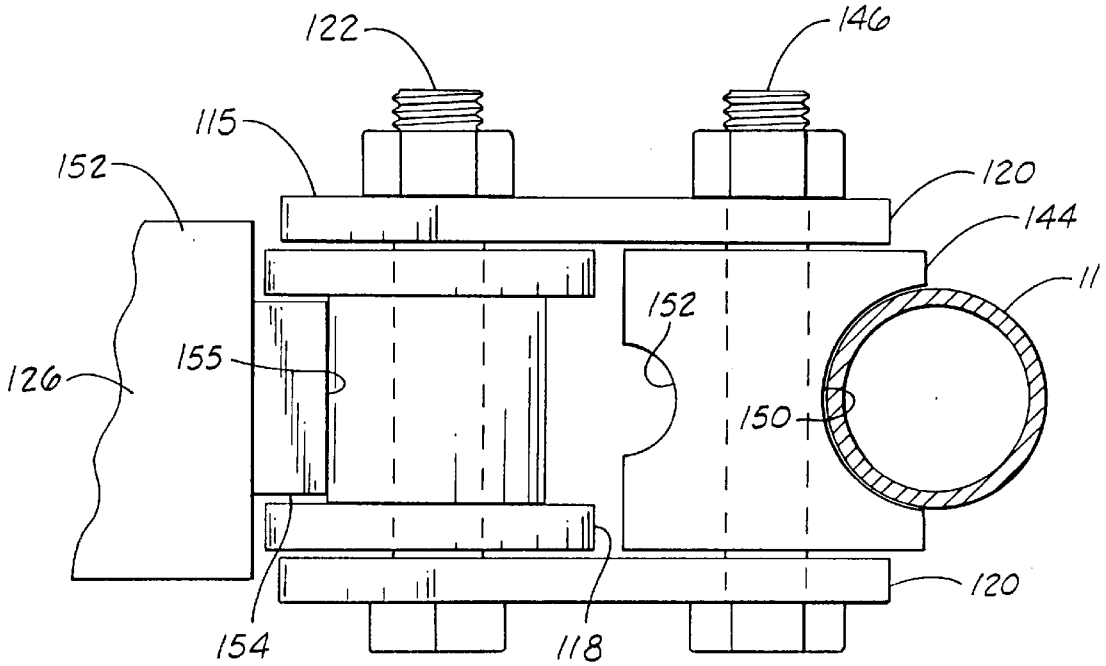
FIG. 5 is a top view of the conveyor chain and gripper block of FIG. 4, also showing the pressing engagement of the skate against the roller of the conveyor chain and the pressing engagement of the gripper block against the tubing.
Figure 5C:
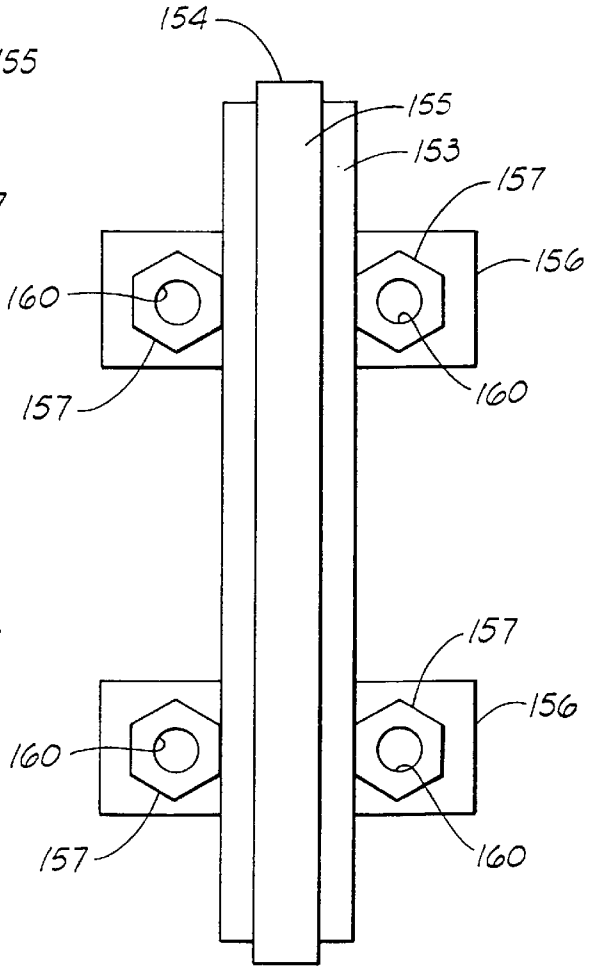
Figure 5B:
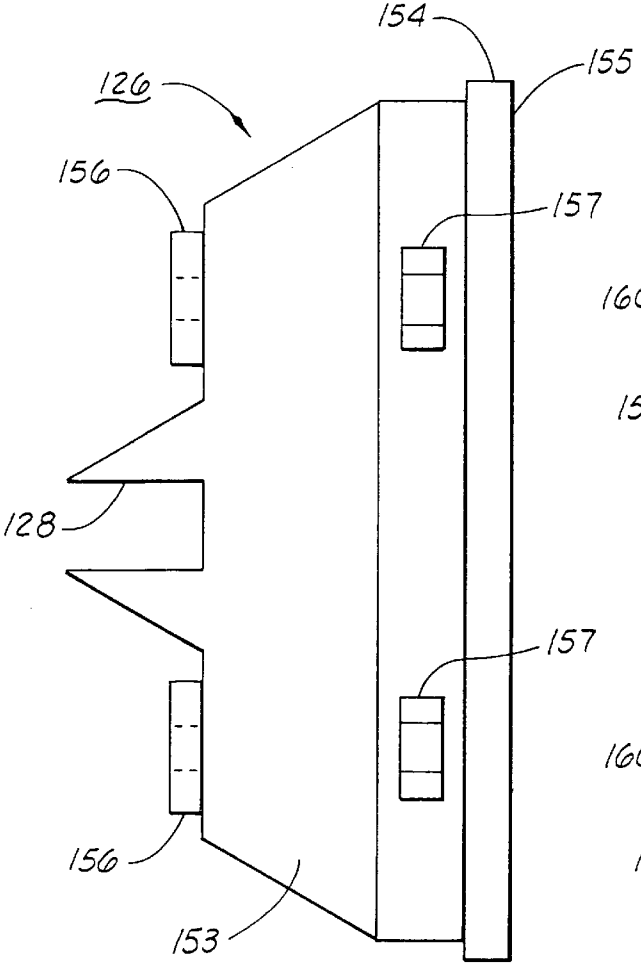
Figure 5A:
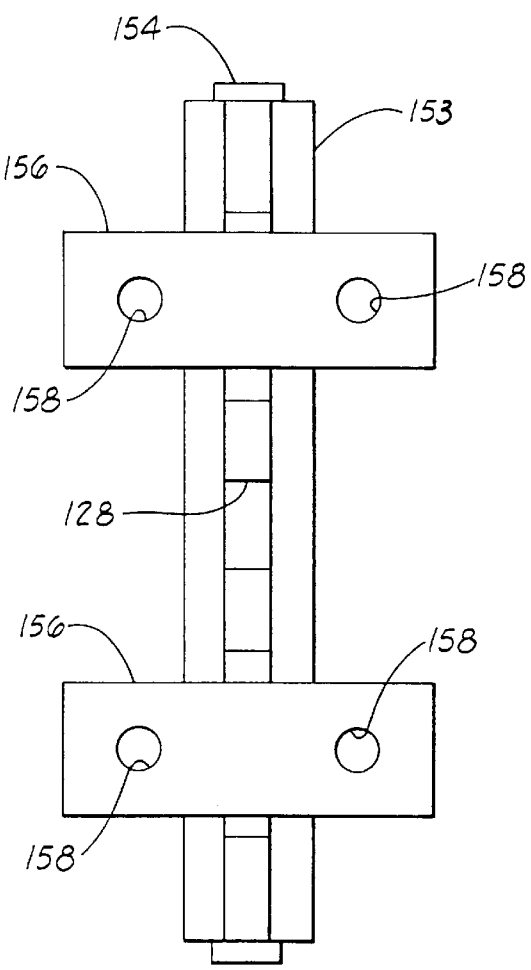

A conveyor chain 114 is trained over the driven sprocket 102 and the free-wheeling sprocket 98, so that rotational motion from the motor 106 is communicated to the conveyor chain 114. The sprocket 98 is mounted to the column support 86 in a conventional manner so as to vary the distance between the sprockets 98 and 102 for the purpose of proper chain tensioning. FIGS. 4 and 5 show a link 115 of the conveyor chain 114, each link 115 having a pair of rollers 116 connected to a pair of opposing links 118. An opposing pair of link plates 120 are connected by fasteners 122 which clearingly pass through apertures (not shown) in the link plates 120 and through the center bores of the rollers 116. A conveyor chain well suited for the purposes of the present invention as described herein is that of a conveyor chain made by Diamond Chain of Indianapolis, Ind., model number WCS2 (one hole).

As shown in FIGS. 2A and 2B, the column support 86 includes a horizontally disposed pin 124, and the grip adjustment assembly 24 includes a skate 126. FIG. 6B is a side view of the skate 126 which forms a slot or notch 128 that receivingly engages the pin 124 to provide pivotal engagement therebetween. The conveyor chain 114, trained over sprockets 98, 102, also is trained over the skate 126 which serves to press the conveyor chain 114 in gripping engagement with the tubing 11 as discussed further below.

Returning to FIGS. 2A and 2B, the opposing fixed conveyor 84, in similar manner to the conveyor 82, has a conveyor chain 130 trained over a free-wheeling sprocket 132, a driven sprocket 134, and a skate 136 that are all supported by a column support 137. The column support 137 is supported by a baseplate 137A a series of bolt receiving openings, and the support frame 20 has several upstanding bolts 137B extending from the rear support rail 66 and the first member 74 of the front support rail. When the baseplate 137A is placed on the support frame 20, the upstanding bolts 137B extend through the receiving openings and securing nuts (not shown) are provided to secure the baseplate 137A in place.

A motor 138 rotates opposite to that of the motor 106 so that if the motor 106 is rotating sprocket 102 in a clockwise direction as depicted by directional arrow 140 in FIG. 2B, the motor 138 rotates sprocket 134 counter-clockwise, depicted by directional arrow 142. The remaining structural details of the conveyor 84 are substantially identical to that described above for the conveyor 82, so the same structure designation numbers are provided in FIGS. 2A and 2B therefor. Further structural description therefore will not be provided herein.

It should be noted that the skates 126 and 136 are supported independently from both of the floating conveyor 82 and fixed conveyor 84, constrained only by the pins 124 which are engaged in the slots 128 and a similar slot 164 of the skates 126, 136, respectively. This unique suspension achieves isolation of the elements which provide the gripping force to the tubing 11 from other forces, and the gripping force can be repeated with regularity without regard to the lateral positions of the conveyors 82, 84.

Returning to FIGS. 4 and 5, a gripper block 144 is supported between the link plates 120 by a bolt fastener 146. Preferably, the bolt fastener 146 has a selected threaded length such that, once tightened, it secures the link plates 120 in spaced apart relationship without pressingly engaging the gripper block 144. In this manner the gripper block 144 is free to pivot about the bolt fastener 146. The pivotal support of the gripper block 144 provides for automatic alignment with the tubing 11, thus maximizing the gripping force while minimizing damage. Preferably, the bolt fastener 146 has a locking nut such as a Nylock brand fastener to prevent loosening during operation. A plurality of gripper blocks 144 are supported by the conveyor chains 114, 130, and cooperate therewith to grip the tubing 11 and provide a path for its linear displacement.

In FIG. 5 the gripper block 144 is pressingly engaging the tubing 11 (shown in cross-section) along an arcuate groove 150, the radius of curvature of the arcuate groove 150 being substantially the same as that of the tubing 11. Frequently it is necessary to insert or withdraw different sizes of tubing into a well. The gripper block 144 of the present invention provides an alternate arcuate groove 152 which has a radius of curvature corresponding to a different size tubing. To change the size, the bolt fastener 146 is removed, the gripper block 144 is rotated 180 degrees, and the bolt fastener 146 is reinstalled. Also, the gripper block 144 in each of the links 115 can be replaced with gripper blocks having selected sizes of grooves as may be necessary to accommodate any size tubing required for a specific location.

The conveyor chains 114, 130 and gripper blocks 144 of the conveyors 82, 84 cooperate to inject tubing 11 into or withdraw tubing 11 from a well. If, as described above and referring to FIG. 2B, the driven sprocket 102 is rotating in direction 140 and the driven sprocket 134 is rotating in direction 142, then the opposing conveyor chains 114, 130 have elongated opposing portions supporting gripper blocks 144 that contact the tubing 11 and displace it upward, which is associated with withdrawing the tubing from a well. Reversing the direction of both motors, therefore, results in the elongated opposing portions of the conveyor chains 114, 130 cooperatively moving in a downward direction, which is associated with inserting the tubing 11 into a well.

An understanding of the gripping system which determines the force with which the gripper blocks 144 engage the tubing 11 requires a preliminary understanding of the construction of the skates 126, 136. As noted above, FIGS. 6A, 6B, and 6C show rear, side and front elevational views, respectively, of the skate 126. The skate 126 is a portion of the grip adjustment assembly 24 and is positioned along the elongated portion of the conveyor chain 114 by the pin 124 of the column support 86. The skate 126 has a central body 153 which forms the slot 128 and which supports a bearing plate 154 having a bearing surface 155, a pair of rear guides 156, and two pairs of front guides 157 (FIG. 6C), one pair on each side of the body 153. Each rear guide 156 has a pair of apertures 158 (FIG. 6A) which are aligned with central bores 160 of the front guides 157 (FIG. 6C). In the embodiment shown, the front guides 157 are made of conventional hexagonal threaded fasteners that have been drilled out to remove the internal threads and thus form substantially smooth central bores 160. The apertures 158 of the rear guides 156 likewise are substantially smooth, non-threaded bores.

Figure 7C:
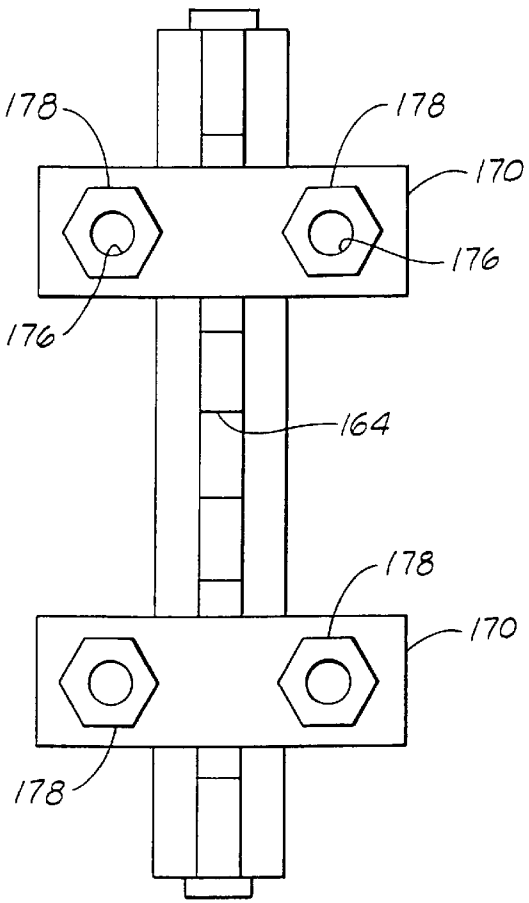
FIG. 7C is a rear elevational view thereof.
Figure 7B:
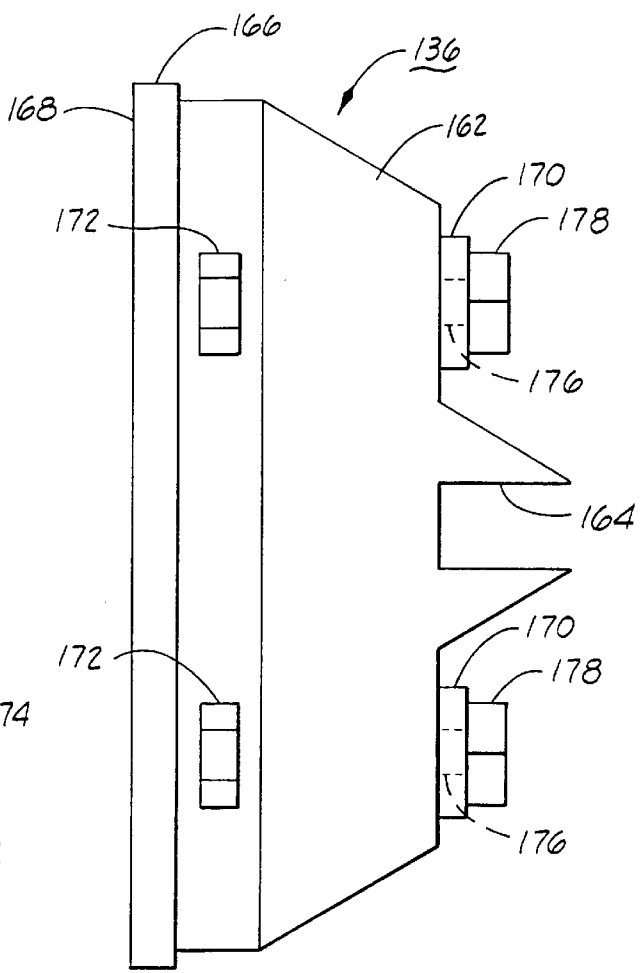
FIG. 7B is a side elevational view.
Figure 7A:
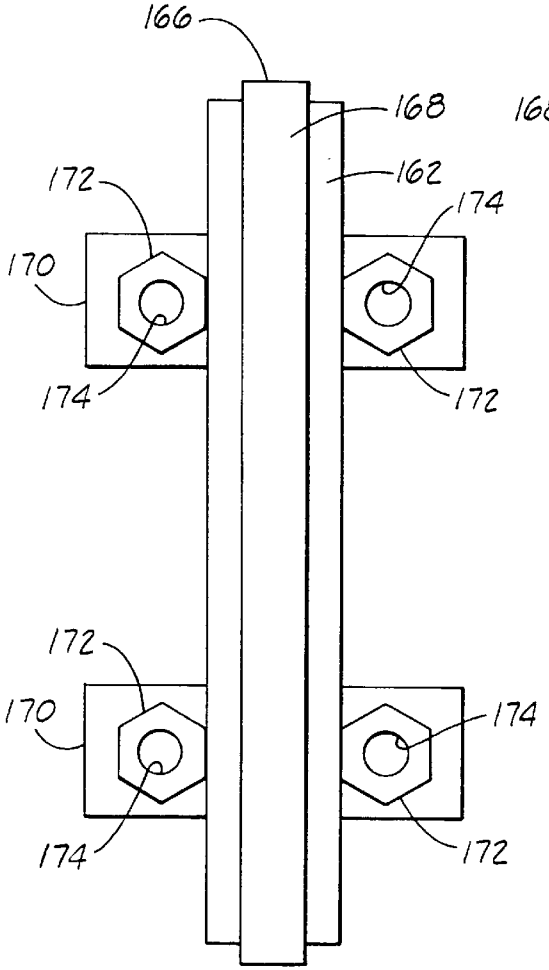
FIG. 7A is a front elevational view of the skate positioned by the moveable conveyor.

FIGS. 7A, 7B, and 7C show front, side and rear elevational views, respectively, of the skate 136. The skate 136, as a portion of the grip adjustment assembly 24, is positioned along the elongated portion of the conveyor chain 130 by the pin 124 of the column support 137. The skate 136 has a central body 162 which forms a slot 164 to engage the horizontal pin 124 supported by the column support 137. The central body 162 supports a bearing plate 166 having a bearing surface 168; a pair of rear guides 170; and two pairs of front guides 172 (FIG. 7A), one pair on each side of the central body 162. Also, the front guides 172 and the rear guides 170 have smooth bored apertures 174, 176, respectively. Unlike the skate 126, the rear guides 170 each support a pair of threaded fasteners 178, the bores of which are coaxially aligned relative to the bored apertures 176. In an alternative embodiment, the threaded fasteners 178 can be omitted if the apertures 176 of the rear guides are thread bearing.

Figure 8:
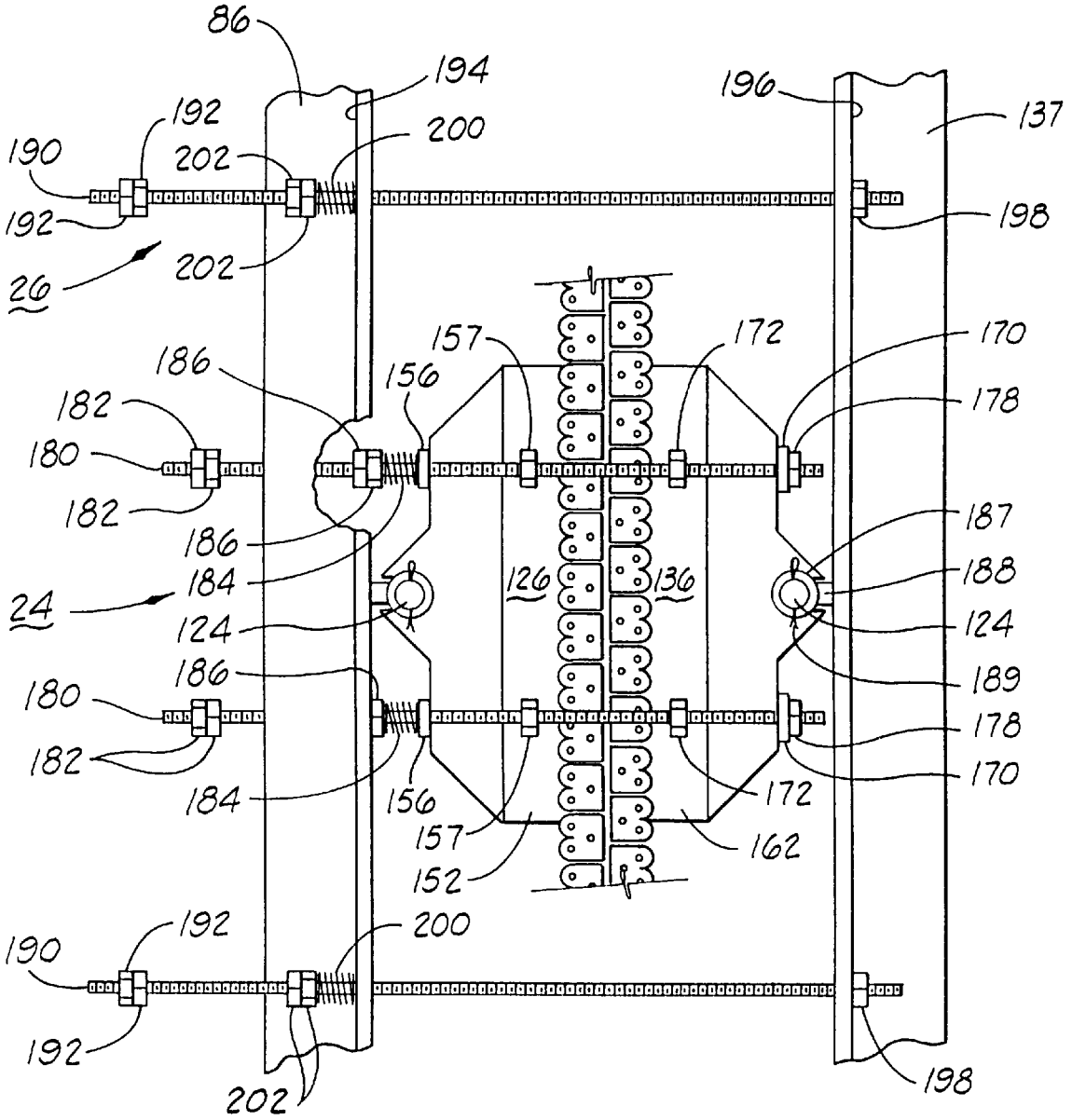
FIG. 8 is a front elevational view of the skates showing the grip adjustment assembly and the conveyor stabilizing assembly.
Figure 8:
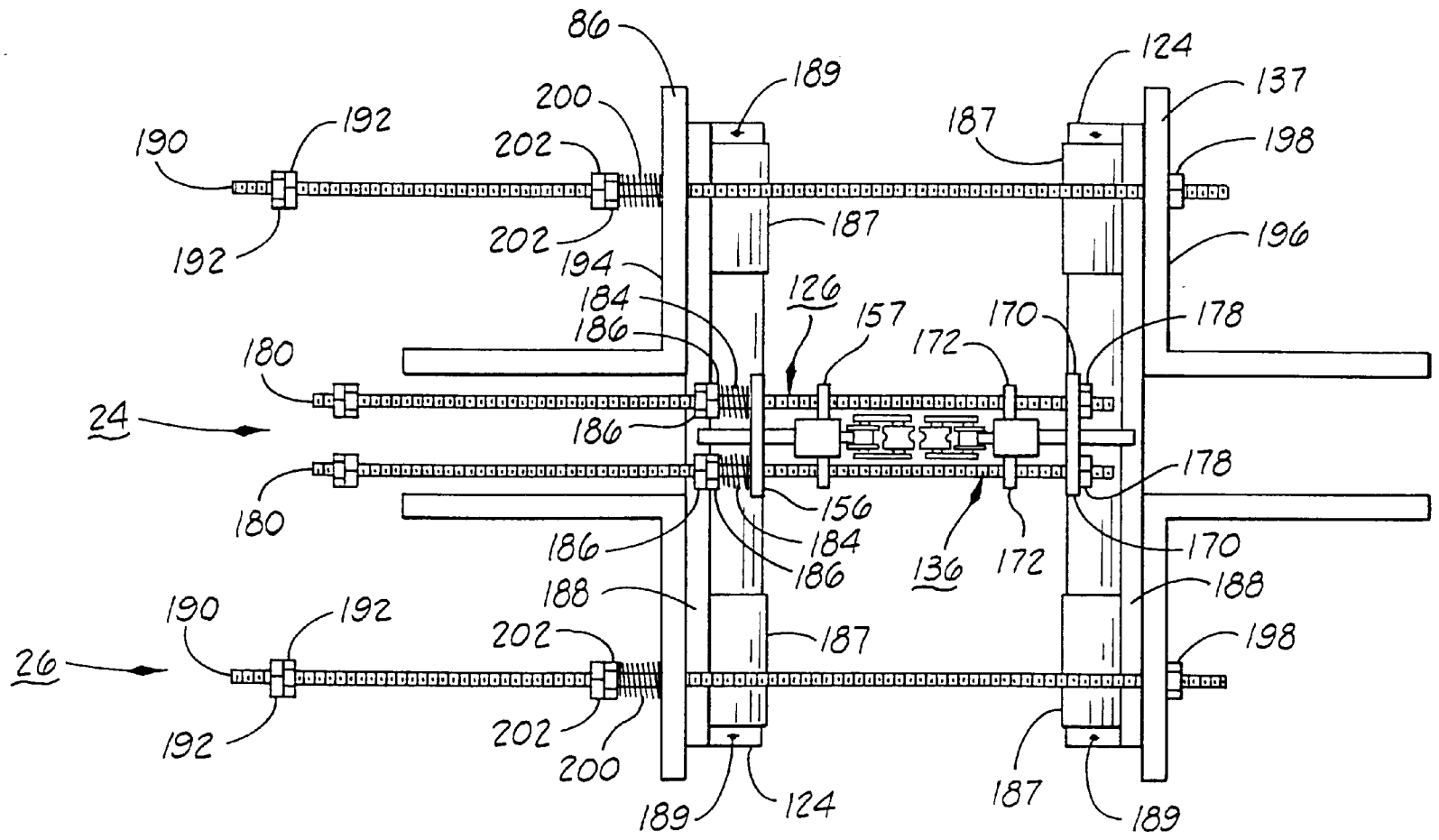

Turning now to FIGS. 8 and 9, shown therein are the grip adjustment assembly 24 and the conveyor stabilizer assembly 26. The grip adjustment assembly 24 has a pair of threaded rods 180, each having two nuts 182 threadingly engaged thereon near a proximate end and tightened against each other to form a hexagonal head which facilitates the turning of the rod 180 with a conventional wrench corresponding to the size of the nuts 182. Each of the rods 180 passes through the rear guide 156 and the front guide 157 on one side of the skate 126, as well as the front guide 172 and the threaded fastener 178 on one side of the skate 136. A spring 184 is compressed between the rear guide 156 and a pair of set nuts 186 which are tightened against each other to lock in place on the threaded rod 180. FIGS. 8 and 9 show that a total of four such threaded rods 180 engage the skates 126, 136, two on each side, one above and one below the horizontal center. As shown, the pins 124, which are engaged by the slots 128 and 164 of the skates 126 and 136, respectively, are supported on the column supports 86, 137 with each pin 124 supported by a pair of coaxially aligned tubular collar supports 187. The tubular collar supports 187 are attached to cross braces 188, and each of the cross braces 188 is in turn attached to the column supports 86, 137. Cotter pins 189 disposed through holes near the ends of the pins 124 assure retention thereof in the collar supports 187.

Returning to FIG. 5, it will be noted that the bearing surface 155 of the bearing plate 154 of skate 126 pressingly engages the roller 116 of the conveyor chain 114. Similarly, the bearing surface 168 of the bearing plate 166 of skate 136 pressingly engages the rollers of the conveyor chain 130. As the force provided by the skates 126, 136, against the conveyor chains 114, 130 increases, therefore, the force with which the gripper blocks 144 grip the tubing 11 is increased. From an understanding of the previously described drawings, it will further be noted that when the distal end of the threaded rod 180 is threadingly engaged with the skate 136, turning the rod 180 in a first direction draws the skates 126, 136 toward each other and hence increases the gripping force on the gripper blocks 144. The skate 126 is influenced by the nuts 186 which compress the spring 184 and, in turn, pressingly engage against the rear guide 156. The skate 136 is influenced in the opposite direction by the threaded engagement of the rod 180 in the threaded fastener 178.

Another distinct advantage of the skate 126, 136 grip adjustment system of the present invention is the ease with which the rods 180 can be removed in order to pass tubing 11 into the gap between the opposing gripper blocks 144. By rotating the rods 180 on one side of this skates 126, 136 in a second rotational direction, the gripping force is lessened and eventually the distal ends of the rods 180 will disengage the threaded fasteners 178. Thereafter, the rods 180 can be pulled away from the skate 136, because the rod 180 slidingly engages the front guide 172 of the skate 136 and the guides 157, 156 of the skate 126.

The conveyor stabilizer assembly 26 provides added strength and rigidity to the column supports 86, 137 during operation of the apparatus. In FIGS. 8 and 9 there are shown several threaded rods 190. Each threaded rod 190 has a pair of nuts 192 tightened against each other near a proximate end to provide a wrench hold of the rod 190. The rod 190 slidingly passes through clearance apertures (not shown) in flanges 194, 196 of the column supports 86, 137, respectively. A threaded member 198 is supported by the flange 196 to threadingly receive a distal end of the rod 190. A spring 200 is compressingly disposed between the flange 194 and a pair of nuts 202 which, like nuts 192, are tightened against each other to lock them in place on the rod 190.

With the rod 190 threadingly engaging the threaded member 198 as shown, turning of the rod 190 in a first rotational direction, as with a wrench on the nuts 192, pulls the column supports 86, 137 together. The column support 86 is influenced by the nuts 202 which compress the spring 200 and which in turn pressingly engages the flange 194. The column support 137 is opposingly influenced by threading engagement of the rod 190 in the threaded member 198.

Four such conveyor threaded rods 190 are employed in the embodiment described, two on each side of the skates 126, 136, one above and one below the horizontal center. In this manner, it will be noted that the conveyors 82, 84 are stabilized by supporting the column supports 86, 137. Like the previously described skate tensioner rods 180, the rods 190 are easily and quickly removed from the path of a tubing 11 string passing into the gap between gripper blocks 144. By turning the rod 190 in a second rotational direction, the distal end will disengage the threaded fastener 198. Thereafter, the rod 190 can be pulled away from the column support 137 because the rod 190 slidingly engages the flange 194.

Figure 10:
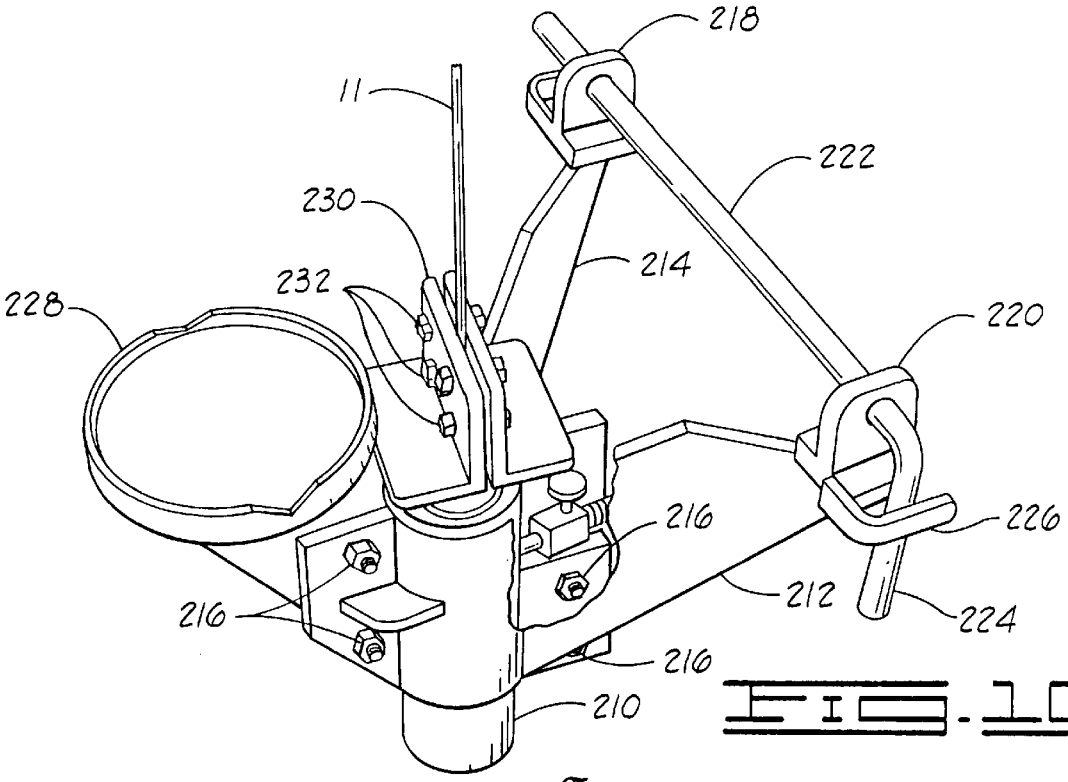
FIG. 10 is an isometric view of the support stand assembly attached to a hydraulic pack-off of a well head, along with a stand-off clamp for supporting the tubing after the tubing insertion and withdrawal assembly of FIG. 2A is removed from the well, leaving the injected tubing in the well.

Yet another novel feature of the present invention is the manner in which the tubing insertion and withdrawal assembly 18 is supported upon a well head during operation of the apparatus. FIG. 1 schematically shows a support stand assembly 204 attached to the upstanding well head and supporting the tubing insertion and withdrawal assembly 18. The support frame 20 has a pair of clevis members 206, 208 which depend from the bottom horizontal member 32. Turning now to FIG. 10, the support stand assembly 204 is shown clamped to a hydraulic pack-off unit 210. In this manner the support stand assembly 204 in conjunction with the hydraulic pack-off unit 210 allows the apparatus of the present invention to insert or withdraw tubing from a live, pressurized well casing.

The support stand assembly 204 provides a two-piece support stand and has a first member 212 and a second member 214 that are joined together by a plurality of fasteners 216. Each of the first and second members 212, 214 forms an arcuate portion which, when joined by fasteners 216, clamps the support stand assembly 204 to the hydraulic pack-off unit 210.

The support stand assembly 204 has a pair of clevis members 218, 220 which are spatially separated so as to flank the clevis members 206, 208 of the support frame 20. With all four clevis members 206, 208, 218, 220 aligned, a pin 222 is inserted therethrough to secure the support frame 20 of the tubing insertion and withdrawal assembly 18 to the support stand assembly 204. The pin 222 has a handle portion 224 which, when the pin 222 is fully inserted, passes into a locking channel formed by a locking tab 226 to retain the pin 222 in a locked position.

The support stand assembly 204 and the support frame 20 of the tubing insertion and withdrawal assembly 18 cooperate such that the pinned alignment of the clevis members 206, 208 with the clevis members 218, 220 places the tubing 11 pathway created by the opposing gripping blocks 144 in alignment with the central opening (not shown) of the hydraulic pack-off unit 210. The support stand assembly 204 furthermore has a platform 228 to support a conventional load cell (not shown). The support frame 20 of the tubing insertion and withdrawal assembly 18 is thus supported upon the load cell so that the weight of suspended tubing 11 can be monitored as it is inserted or withdrawn to anticipate difficulties associated with restrictions to a smooth insertion or withdrawal of the tubing 11 from the oil well 12.

Figure 11:
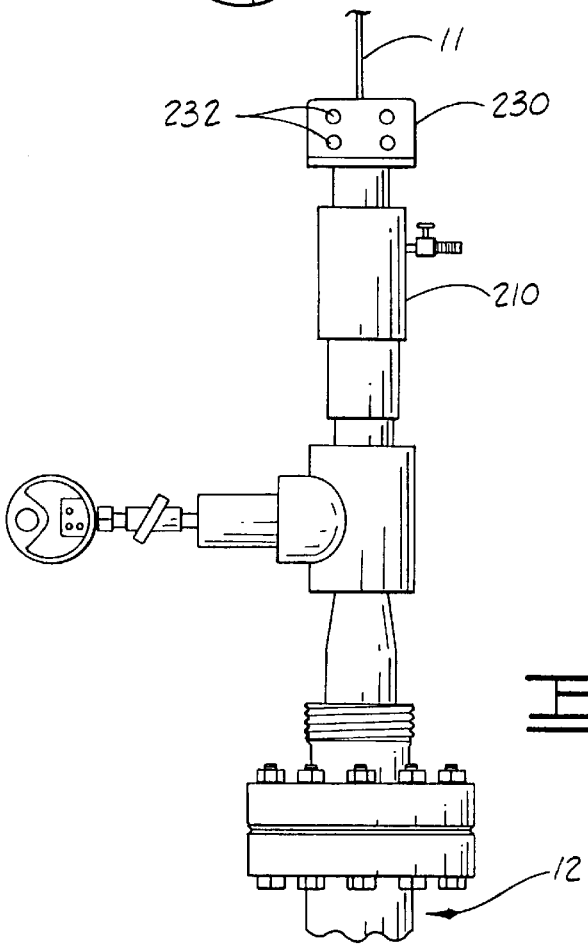
FIG. 11 is an elevational view of the stand-off clamp supporting the injected tubing after the coiled tubing injector of FIG. 1 has been removed from the well site.

A tube stand-off clamp 230 is constructed of a pair of angle-iron members with a groove (not shown) in the mating faces to receivingly engage the tubing 11. The opposing angle-iron members are joined by a plurality of fasteners 232. The fasteners 232 can be loosened to allow the tubing 11 to slidingly pass while being inserted or withdrawn from a well. When the tubing 11 has been inserted to a desired depth, the fasteners 232 can be tightened to grippingly retain the tubing 11 at the desired depth. With the stand-off clamp 230 thus tightened and supporting the string of tubing 11 in the well, the tubing insertion and withdrawal assembly 18 can be removed from the tubing 11 if necessary. The support stand assembly 204 can also be removed from the hydraulic pack-off unit 210 by removing the fasteners 216 to separate the members 212, 214. FIG. 11 illustrates a oil well 12 head with the hydraulic pack-off unit 210 wherein the tubing insertion and withdrawal assembly 18 and the support stand assembly 204 of the present invention have been removed after the tubing 11 has been inserted.

Returning to FIG. 1, shown therein is the tubing guide 16 which is detachingly supported by the tubing insertion and withdrawal assembly 18. The tubing guide 16 forms an arcuate support for the coiled tubing during the transition from a coiled roll and delivers the tubing to the tubing insertion and withdrawal assembly 18 where the tubing is gripped by the conveyors 82, 84. A pair of opposing tube guides 234 (FIG. 2A), 236 (FIG. 2B) are medially supported by the conveyors 82, 84 adjacent the tubing guide 16 and the conveyor chains 114, 130 to urge the tubing 11 into the tubing path created by the opposing gripper blocks 144. Similarly, a pair of opposing tube guides 238 (FIG. 2A), 240 (FIG. 2B) are similarly supported by the opposing conveyors 82, 84 at the lower ends thereof. Preferably, these guides have high-density composite wear surfaces, such as nylon, to prevent scarring of the tubing 11 being injected into, or removed from, the oil well 12. The tube guides 234, 236 and 238, 240 may be pivotally supported by one of the conveyors 82, 84 to facilitate movement thereof to clear a path for a tubing 11 string that is passing into the gap between the opposing gripper blocks 144.

Figure 12:
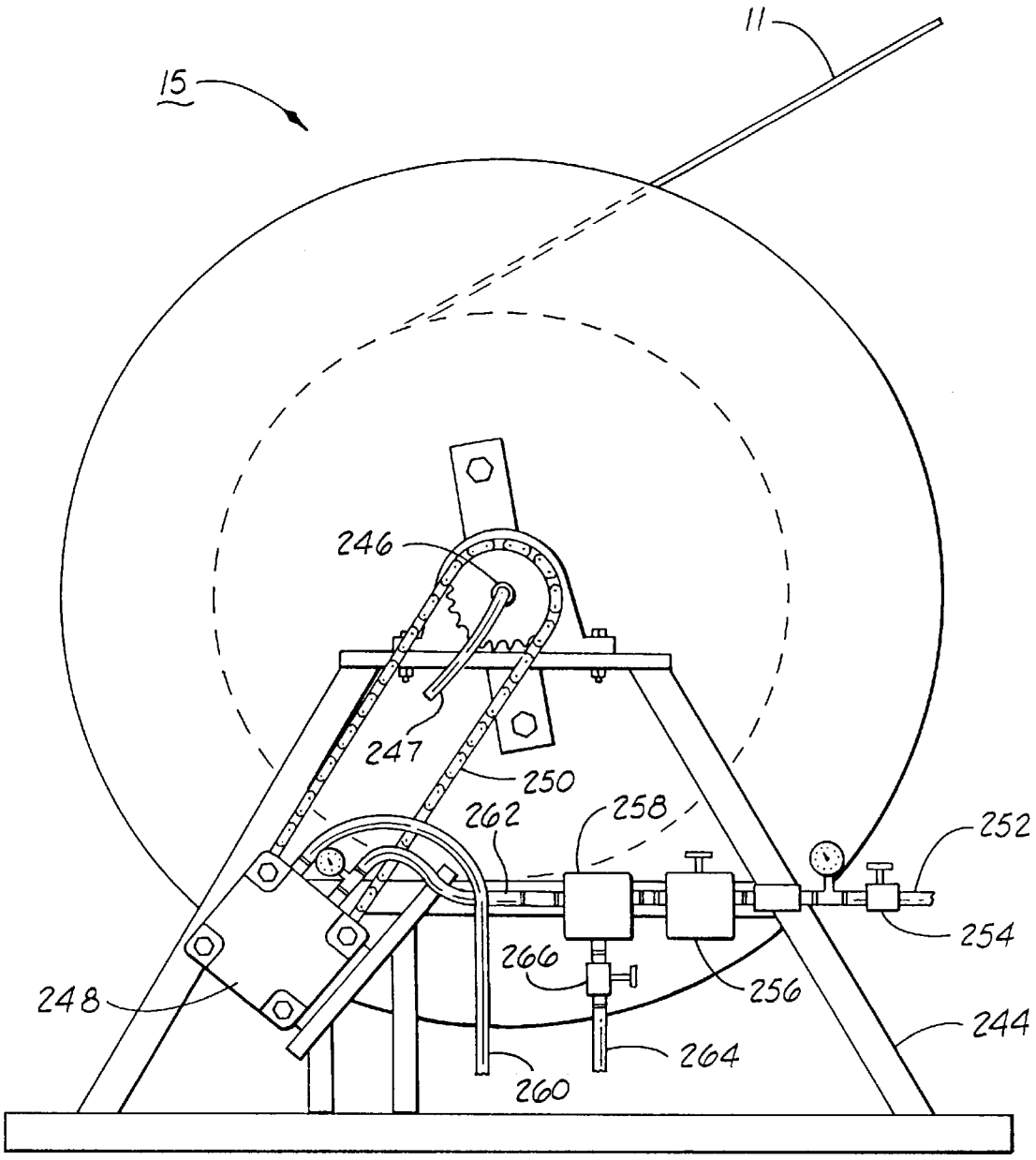
FIG. 12 is an elevational view of the tubing decoiler of the coiled tubing injector of FIG. 1.

As FIG. 1 shows, the tubing 11 is stored in a coiled roll on a spool 242 that is supported by a tubing decoiler assembly 15. FIG. 12 shows the tubing decoiler assembly 15, wherein it will be noted that a cradle support frame 244 supports a shaft (not shown) which attaches to the spool 242 for rotation thereon. A fluid swivel 246 is provided at one end of the shaft to provide fluid communication between a supply line 247 and the tubing 11 for the flow of desired fluids into the oil well 12 through an injected string of tubing 11. The shaft is controllably rotated by a hydraulic motor 248 and an interconnecting chain 250. The motor 248 is used to impart a braking force to the spool 242 during lowering of the tubing 11, in order to provide tension on the tubing 11 to aid in straightening it as it traverses the tubing guide 16, and furthermore to prevent backlash uncoiling of the spool 242. The motor 248 is also used in the reverse direction to wind the tubing 11 back onto the spool 242 when the tubing 11 is withdrawn from the well.

A hydraulic pressure line 252 delivers pressurized hydraulic fluid from a reservoir (not shown) to the tubing decoiler assembly 15. A metering valve 254 provides a speed control for the motor 248 during such times that it is used to wind the tubing 11 back onto the spool 242 as the tubing 11 is withdrawn from the oil well 12. A pressure control valve 256 regulates the pressure exerted on the tubing 11 as it is being withdrawn. A solenoid valve 258 is used to switch the motor 248 between a first mode wherein it provides a brake on the tubing 11 as it is decoiled, and a second mode wherein it provides the power to wind the tubing 11 back onto the spool 242.

In the first mode, the solenoid valve 258 is not energized, resulting in a blockage of pressurized fluid in line 252 past the solenoid valve 258. In the unenergized state a flow path exists from the reservoir to the motor 248 by line 260, and out of the motor 248 back to the reservoir by line 262 and line 264. In this mode the motor 248 acts as a hydraulic pump between suction line 260 and return line 264. A metering valve 266 on the return line 264 allows a variable back pressure so as to control the tension on the tubing 11 as it is decoiled from the spool 242.

In the second mode, the solenoid valve 258 is energized, resulting in a flow of pressurized fluid from line 252 to line 262 and into the hydraulic motor 248. The fluid returns to the reservoir in line 260. In this mode the motor 248 operates with a selected constant pressure as determined by the pressure control valve 256 and a selected speed as determined by the speed control valve 254.

Finally, FIG. 1 shows an articulating boom lift assembly 17 is provided to place the tubing insertion and withdrawal assembly 18 into a working position on the support stand assembly 204 as described above, and also to load and unload spools 242 of tubing onto the tubing decoiler 15. A pair of horizontal lift members 268, 270 (FIG. 3) on the rear face of the support frame 20 of the tubing insertion and withdrawal assembly 18 are provided to support stabilizing bars 272, 274 which are opposingly supported by the mobile platform 19.

It is clear that the present invention is well adapted to carry out the objects and to attain the ends and advantages mentioned as well as those inherent therein. While presently preferred embodiments of the invention have been described in varying detail for purposes of the disclosure, it will be understood that numerous changes may be made which will readily suggest themselves to those skilled in the art and which are encompassed within the spirit of the invention disclosed and as defined in the above text and in the accompanying drawings.

What is claimed is:

1. A coiled tubing injector for inserting and withdrawing a continuous length of tubing from a well, wherein the well has a hydraulic pack-off unit at an upper end to contain an internal pressure of the well, the coiled tubing injector comprising:

a support stand assembly supported by the hydraulic pack-off unit;

a frame supported by the support stand assembly;

a tubing conveyor assembly supported by the frame providing a path for engagement of the tubing for movement thereof;

a grip adjustment assembly for urging the tubing conveyor assembly against the tubing to exert a gripping force thereon; and a power assembly for operably moving the tubing conveyor assembly.

2. A coiled tubing injector for inserting and withdrawing a continuous length of tubing from a well, the tubing having a leading end, a trailing end, and a medial portion therebetween, the coiled tubing injector comprising:

a frame having a passageway enabling passage of the medial portion of the tubing into the frame notwithstanding the position of the ends relative to the frame;

a tubing conveyor assembly supported by the frame in alignment with the passageway providing a path for operable engagement of the tubing;

a grip adjustment assembly for urging the tubing conveyor assembly against the tubing to exert a gripping force thereon; and a power assembly for operably moving the tubing conveyor assembly.

3. A coiled tubing injector for inserting and withdrawing a continuous length of tubing from a well, comprising:

a frame comprising a passageway for the passing of a medial portion of the tubing laterally into the frame, a tubing conveyor assembly supported by the frame providing a path for engagement of the tubing for movement thereof, comprising:

a fixed conveyor supported by the frame; and an opposed floating conveyor slidingly supported by the frame and slidingly moveable away from the fixed conveyor to create a gap therebetween, a grip adjustment assembly for urging the tubing conveyor assembly against the tubing to exert a gripping force thereon; and a power assembly for operably moving the tubing conveyor assembly.

4. The coiled tubing injector of claim 3 further comprising a conveyor stabilizing assembly connecting the fixed conveyor and the floating conveyor for supporting the floating conveyor.

5. The coiled tubing injector of claim 3 wherein each of the conveyors comprises:

a column support supported by the frame;

a pair of sprockets supported for rotation by the column support;

a conveyor chain trained over the sprockets; and a plurality of gripper blocks supported by the conveyor chain.

6. The coiled tubing injector of claim 5 wherein each sprocket is supported by a shaft that is rotatably supported by a bearing mounted to the column support, wherein the shaft furthermore supports a drive sprocket, and wherein the power assembly comprises:

a motor having an output shaft which supports a motor sprocket; and a chain trained over the motor sprocket and the drive sprocket so as to impart rotational motion of the output shaft to the conveyor chain.

7. The coiled tubing injector of claim 3 wherein the tubing conveyor assembly has an elongated portion where the conveyors opposingly grip the tubing, and wherein the grip adjustment assembly comprises:

a first skate member positioned along the elongated portion by the column support of the fixed conveyor;

an opposed second skate member positioned along the elongated portion by the column support of the floating conveyor; and a grip adjustment rod which has a medial portion thereof which pressingly engages the first skate member, and a distal end thereof which threadingly engages the second skate member, so that rotational movement of the grip adjustment rod in a first rotational direction urges the skates toward each other so as to increase a gripping force exerted by the gripper blocks on the tubing.

8. The coiled tubing injector of claim 5 wherein the conveyor stabilizing assembly comprises a stabilizing rod which has a medial portion that pressingly engages the column support of the fixed conveyor, and a distal end which threadingly engages the floating conveyor, so that rotational movement of the stabilizing rod in a first rotational direction urges the column support of the floating conveyor toward the column support of the fixed conveyor so as to provide stabilizing support to the floating conveyor.

9. The coiled tubing injector of claim 3 wherein the well has a hydraulic pack-off unit at an upper end to contain the internal pressure of the well, and wherein the coiled tubing injector further comprises a support stand assembly supported by the hydraulic pack-off unit, the support stand assembly comprising:

a first support stand member having an arcuate portion with a radius of curvature substantially that of the hydraulic pack-off unit, and furthermore having a support leg;

a second support stand member having an arcuate portion with a radius of curvature substantially that of the hydraulic pack-off unit, furthermore having a support leg, and furthermore having a platform portion; and a fastener for attaching the first and second support stand members so that the arcuate portions pressingly engage the hydraulic pack-off unit to clamp the support stand assembly to thereto.

10. The coiled tubing injector of claim 9 wherein the frame has a supporting portion that engages the support legs of the support stand assembly to align the tubing conveyor assembly and the hydraulic pack-off so that the path for engagement of the tubing is operably aligned with a passageway in the hydraulic pack-off.

11. The coiled tubing injector of claim 10 wherein the supporting portion of the frame has a clevis member, and wherein each of the support legs of the support stand assembly has a clevis member, and wherein a locking pin slidingly engages the clevis members of the support stand assembly and the frame to provide a hinged support of the frame by the support stand assembly.

12. The coiled tubing injector of claim 11 further comprising a load sensing member interposed between the platform of the support stand assembly and the frame for measuring reaction loads on the frame during insertion and withdrawal of tubing.

13. The coiled tubing injector of claim 3 further comprising a tubing guide supported by the frame for guiding the tubing from a reel to the tubing conveyor assembly, the guide comprising a substantially arcuate boom member having an arcuate supporting surface which engages the tubing to support and deliver it to the tubing conveyor assembly.

14. The coiled tubing injector of claim 3 further comprising:

a first pair of opposed tubing supports supported by the conveyor assembly and spanning the path for engagement of the tubing at an upper end, the first pair of tubing supports having a bearing surface which urges the tubing into the tubing conveyor assembly; and a second pair of opposed tubing supports supported by the conveyor assembly and spanning the path for engagement of the tubing at a lower end of the conveyor assembly, the second pair of tubing supports having a bearing surface which supports the tubing at a portion where it is leaving the conveyor assembly.

15. The coiled tubing injector of claim 14 wherein the bearing surface of the tubing supports is nylon.

16. The coiled tubing injector of claim 3 further comprising:

a mobile platform;

a tubing decoiler assembly supported by the platform;

an articulating boom lift assembly supported by the platform, for placing the frame on the well;

a power supply assembly supported by the mobile platform; and a control panel.

17. The coiled tubing injector of claim 16 wherein the tubing decoiler assembly supports a spool of tubing and provides a variable braking force on the tubing while the tubing is paid out into a well, the decoiler assembly providing a reeling force to rewind the tubing, comprising:

a supporting frame;

a shaft rotatably supported by the frame which supports the spool;

a motor;

a chain connecting the motor to the shaft for transmitting rotation therebetween; and control means, comprising:

a solenoid valve on the supply line having an energized and an unenergized mode;

a motor inlet line from the solenoid valve to the motor which provides fluid communication of pressurized hydraulic fluid to the motor when the solenoid is in the energized mode;

a motor outlet line from the motor to the reservoir;

a throttling line from the solenoid valve to the reservoir that is in fluid communication with the motor inlet line when the solenoid valve is in the unenergized mode; and a throttling valve disposed in the throttling line; and wherein the energized mode of the solenoid valve provides pressurized hydraulic fluid to the motor to wind the tubing onto the spool as the tubing insertion and withdrawal assembly withdraws the tubing from the well, and wherein the unenergized mode of the solenoid valve provides a fluid path for the pumping of hydraulic fluid from the reservoir and back into the reservoir by the motor, the flow rate of the fluid being pumped being determined by a selected position of the throttling valve so as to selectively determine the braking force on the tubing as it is inserted into the well by the tubing insertion and withdrawal assembly.

18. A coiled tubing injector for inserting and withdrawing a continuous length of tubing from a well, the coiled tubing injector comprising:

a tubing insertion and withdrawal assembly comprising:

a support frame having an extending passageway for admission of a medial portion of the tubing therein;

a tubing conveyor assembly supported by the frame for engaging the medial portion of the tubing and moving the tubing into and out of the well;

a grip adjustment assembly for urging the tubing conveyor assembly against the tubing to exert a gripping force on the tubing; and a power assembly for operably moving the tubing conveyor assembly; and support means for supporting the tubing insertion and withdrawal assembly on the well.

19. The coiled tubing injector of claim 18 wherein the tubing conveyor assembly comprises:

a fixed conveyor supported by the support frame; and an opposed floating conveyor supported by the frame, the fixed conveyor and the floating conveyor cooperating to engage and move the tubing, the floating conveyor slidingly moveable away from the fixed conveyor to create a gap therebetween.

20. The coiled tubing injector of claim 19 further comprising:

a conveyor stabilizing assembly connecting the fixed conveyor and the floating conveyor for supporting the floating conveyor.

21. The coiled tubing injector of claim 20 wherein each of the fixed conveyor and the floating conveyor comprises:

a column support supported by the support frame;

a pair of sprockets supported for rotation by the column support;

a conveyor chain trained over the sprockets; and a plurality of gripper blocks supported by the conveyor chain.

22. The coiled tubing injector of claim 21 wherein each sprocket is supported by a shaft that is rotatably supported by a bearing mounted to the column support, wherein the shaft furthermore supports a drive sprocket, and wherein the power assembly comprises:

a motor having an output shaft which supports a motor sprocket; and a chain trained over the motor sprocket and the drive sprocket so as to impart rotational motion of the output shaft to the conveyor chain.

23. The coiled tubing injector of claim 21 wherein the tubing conveyor assembly has an elongated portion where the conveyors opposingly grip the tubing, and wherein the grip adjustment assembly comprises:

a first skate member positioned along the elongated portion by the column support of the fixed conveyor;

an opposed second skate member positioned along the elongated portion by the column support of the floating conveyor; and a grip adjustment rod which has a medial portion thereof which pressingly engages the first skate member, and a distal end thereof which threadingly engages the second skate member, so that rotational movement of the grip adjustment rod in a first rotational direction urges the skates toward each other so as to increase a gripping force exerted by the gripper blocks on the tubing.

24. The coiled tubing injector of claim 21 wherein the conveyor stabilizing assembly comprises a stabilizing rod which has a medial portion that pressingly engages the column support of the fixed conveyor, and a distal end which threadingly engages the column support of the floating conveyor, so that rotational movement of the stabilizing rod in a first rotational direction urges the column support of the floating conveyor toward the column support of the fixed conveyor to stabilize the floating conveyor.

25. The coiled tubing injector of claim 18 wherein the well has a hydraulic pack-off unit at an upper end to contain the internal pressure of the well, and wherein the coiled tubing injector further comprises a support stand assembly supported by the hydraulic pack-off unit, the support stand assembly comprising:

a first support stand member having an arcuate portion with a radius of curvature substantially that of the hydraulic pack-off unit, and furthermore having a support leg;

a second support stand member having an arcuate portion with a radius of curvature substantially that of the hydraulic pack-off unit, furthermore having a support leg, and furthermore having a platform portion; and a fastener for attaching the first and second support stand members so that the arcuate portions pressingly engage the hydraulic pack-off unit to clamp the support stand assembly to thereto.

26. The coiled tubing injector of claim 25 wherein the tubing insertion and withdrawal assembly has a supporting portion that engages the support legs of the support stand assembly to align the tubing conveyor assembly and the hydraulic pack-off so that the path for engagement of the tubing is operably aligned with a passageway in the hydraulic pack-off.

27. The coiled tubing injector of claim 26 wherein the supporting portion of the tubing insertion and withdrawal assembly has a clevis member, and wherein each of the support legs of the support stand assembly has a clevis member, and wherein a locking pin slidingly engages the clevis members of the support stand assembly and the tubing insertion and withdrawal assembly to provide a hinged support of the tubing insertion and withdrawal assembly by the support stand assembly.

28. The coiled tubing injector of claim 27 further comprising a load sensing member interposed between the platform of the support stand assembly and the tubing insertion and withdrawal assembly for measuring reaction loads on the tubing insertion and withdrawal assembly during insertion and withdrawal of tubing.

29. The coiled tubing injector of claim 18 further comprising a tubing guide supported by the tubing insertion and withdrawal assembly for guiding the tubing from a reel to the tubing conveyor assembly, the guide comprising a substantially arcuate boom member having an arcuate supporting surface which engages the tubing to support and deliver it to the tubing conveyor assembly.

30. The coiled tubing injector of claim 29 further comprising:

a first pair of opposed tubing supports supported by the tubing conveyor assembly and spanning the path for engagement of the tubing at an upper end, the first pair of tubing supports having a bearing surface which urges the tubing into the tubing conveyor assembly; and a second pair of opposed tubing supports supported by the conveyor assembly and spanning the path for engagement of the tubing at a lower end of the conveyor assembly, the second pair of tubing supports having a bearing surface which supports the tubing at a portion where it is leaving the conveyor assembly.

31. The coiled tubing injector of claim 30 wherein the bearing surface of the tubing supports is nylon.

32. In a well, a method for injecting a continuous length of tubing into the well with a tubing injector apparatus and removing the tubing injector apparatus from the continuous length of tubing, comprising the steps:

(a) moving a floating conveyor away from a fixed conveyor to provide a gap therebetween;

(b) placing a medial portion of the tubing into the gap between the fixed and floating conveyors;

(c) moving the floating conveyor toward the tubing so that the floating conveyor and the fixed conveyor engage the tubing;

(d) urging the floating conveyor and the fixed conveyor into gripping engagement with the tubing;

(e) advancing the conveyors to move the tubing in a direction toward the well to insert a portion of the tubing into the well;

(f) releasing the gripping force and moving the floating conveyor away from the fixed conveyor to form the gap therebetween; and (g) removing the tubing injector apparatus from the continuous tubing.

* * * * *

UNITED STATES PATENT AND TRADEMARK OFFICE

CERTIFICATE OF CORRECTION

PATENT NO. : 5,937,943
DATED : August 17, 1999
INVENTOR(S) : Wilbur T. Butler

It is certified that error appears in the above-identified patent and that said Letters Patent is hereby corrected as shown below:

Column 13,
Line 18, replace “assembly to thereto” with -- assembly thereto --.

Column 15,
Line 64, replace “assembly to thereto” with -- assembly thereto --.

Column 16,
Line 36, replace “the conveyor assembly” with -- the tubing conveyor assembly --.

Signed and Sealed this

Thirtieth Day of July, 2002

*Attest:*

*Attesting Officer*

JAMES E. ROGAN
*Director of the United States Patent and Trademark Office*